US009736564B2

(12) United States Patent
Kurtz

(10) Patent No.: US 9,736,564 B2
(45) **Date of Patent: *Aug. 15, 2017**

(54) FLEXIBLE EARPHONE COVER FOR EARPHONES WITH SENSORS

(71) Applicant: Jon Robert Kurtz, W. Hollywood, CA (US)

(72) Inventor: Jon Robert Kurtz, W. Hollywood, CA (US)

(73) Assignee: Jon Robert Kurtz, W. Hollywood, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/439,758

(22) Filed: Feb. 22, 2017

(65) Prior Publication Data

US 2017/0164087 A1 Jun. 8, 2017

Related U.S. Application Data

(63) Continuation of application No. 15/063,327, filed on Mar. 7, 2016, which is a continuation of application No. 14/261,294, filed on Apr. 24, 2014, now Pat. No. 9,307,313.

(51) Int. Cl.

| | |
|---|---|
| ***H04R 1/10*** | (2006.01) |
| ***H04R 1/34*** | (2006.01) |
| *H04R 1/12* | (2006.01) |

(52) U.S. Cl.

CPC ..... *H04R 1/1016* (2013.01); *H04R 1/105* (2013.01); *H04R 1/1066* (2013.01); *H04R 1/345* (2013.01); *H04R 1/1091* (2013.01); *H04R 1/12* (2013.01)

(58) Field of Classification Search

CPC .... H04R 1/105; H04R 1/1016; H04R 1/1066; H04R 25/652; H04R 25/656

See application file for complete search history.

(56) References Cited

U.S. PATENT DOCUMENTS

| | | | |
|---|---|---|---|
| 2,487,038 | A | 11/1949 | Baum |
| 2,508,918 | A | 5/1950 | Hines, Jr. |
| 4,349,083 | A | 9/1982 | Bennett |
| 5,319,163 | A | 6/1994 | Scott |
| 6,411,722 | B1 | 6/2002 | Wolf |
| D686,197 | S | 7/2013 | Kurtz et al. |
| D691,594 | S | 10/2013 | Akana et al. |
| 8,638,970 | B2 | 1/2014 | Burton |
| 2005/0141743 | A1 | 6/2005 | Seto |

(Continued)

*Primary Examiner* — Matthew Eason

(74) *Attorney, Agent, or Firm* — Morgan, Lewis & Bockius LLP

(57) ABSTRACT

The flexible earphone cover has a flexible main body and a flexible ear cone that extends from the main body. The flexible main body is configured to substantially encase a portion of an earphone. The flexible main body defines an internal cavity for receiving the earphone. It also defines a first opening at a side of the cavity for receiving the earphone there-through. The flexible main body defines a second opening at a side of the cavity. The flexible main body defines a third opening at a side of the cavity. The flexible main body further defines a fourth opening next to the first opening and a fifth opening next to the third opening. The flexible ear cone defines a converging passageway from the second opening to an exit configured to direct sound into an ear canal of an ear of a user.

29 Claims, 12 Drawing Sheets

(56) References Cited

U.S. PATENT DOCUMENTS

| | | | | |
|---|---|---|---|---|
| 2005/0147269 | A1 | 7/2005 | Oliveira et al. | |
| 2012/0237074 | A1 | 9/2012 | Aase | |
| 2013/0343594 | A1 | 12/2013 | Howes et al. | |
| 2013/0343595 | A1 | 12/2013 | Zorkendorfer et al. | |
| 2014/0068944 | A1* | 3/2014 | Aase ..... | H04R 31/006 29/896.2 |
| 2014/0138179 | A1 | 5/2014 | Burton | |

* cited by examiner

FLEXIBLE EARPHONE COVER FOR EARPHONES WITH SENSORS

CROSS REFERENCE TO RELATED APPLICATIONS

This application is a continuation-in-part of U.S. patent application Ser. No. 15/063,327, entitled "Flexible Earphone Cover," filed on Mar. 7, 2016, which is a continuation application of U.S. patent application Ser. No. 14/261,294 (U.S. Pat. No. 9,307,313), entitled "Flexible Earphone Cover," filed on Apr. 24, 2014, the entireties of which are incorporated by reference herein.

FIELD OF THE INVENTION

The disclosed embodiments relate generally to audio devices, and in particular to covers for in-ear earphones.

BACKGROUND

Ever since the advent of portable media players, such as the SONY WALKMAN and later the APPLE IPOD, people have been listening to music on the go. Nowadays, most, if not all, smart phones include built-in media players. As such, a large percentage of the developed world's population listens to music on portable devices. Often, users wear headphones or earphones to keep private what they are listening to or to not disturb others around them. Many users prefer using earphones over headphones due to their compact size, lightweight, and ease of portability. Headphones are typically placed on or over a user's ear, whereas earphones are smaller than headphones and include small speakers that fit into the outer ear of the wearer, making earphones easier to carry and use on-the-go. Some earphones also direct sound down the user's external auditory meatus or ear canal to the user's tympanic membrane or eardrum where the sound is converted into vibrations that are perceived by the brain as sound.

These days, most portable media players and smart phones are sold with the media player manufacture's standard earphones, such as APPLE'S EARBUDS or EARPODS®, or AIRPODS™. These standard earphones are typically made from a rigid material having a smooth outer surface, and are sized for the average person's ear. As such, these standard earphones suffer from a number of drawbacks, such as: (i) not fitting snuggly within all wearer's ears, (ii) made of a hard plastic resulting in the earphones slipping-out of the wearer's ears when the wearer is moving or exercising and/or when the earphone's outer surface is moist from, for example, perspiration, (iii) being uncomfortable when worn for a long period of time, (iv) not adequately directing sound into a user's ear canal, and (v) not adequately blocking ambient noise.

Moreover, earphones, like APPLE's EARPODS® or AIRPODS™, are designed so that the main speaker is covered by a grill that is recessed, i.e., the housing of the earphone extends further than the speaker grill. This design allows unwanted material, such as pocket lint or earwax, to get caught in the recess. Over time the recess collects this unwanted material, which is not easily visible to the user. This unwanted material may degrade the sound quality. Moreover this recess is difficult to clean and could lead to infection or in-ear irritation.

While some covers exist for earphones, these covers are not designed to fit the current style of many earphones; are not removable; are overly complex; or fail to address the above drawbacks. Accordingly, it would be desirable to provide a cover for an earphone that allows users to use their existing earphones, while still addressing the above mentioned drawbacks.

BRIEF DESCRIPTION OF THE DRAWINGS

So that the present disclosure can be understood in greater detail, a more particular description may be had by reference to the features of various embodiments, some of which are illustrated in the appended drawings. The appended drawings, however, merely illustrate the more pertinent features of the present disclosure and are therefore not to be considered limiting, for the description may admit to other effective features.

Figure 1A:
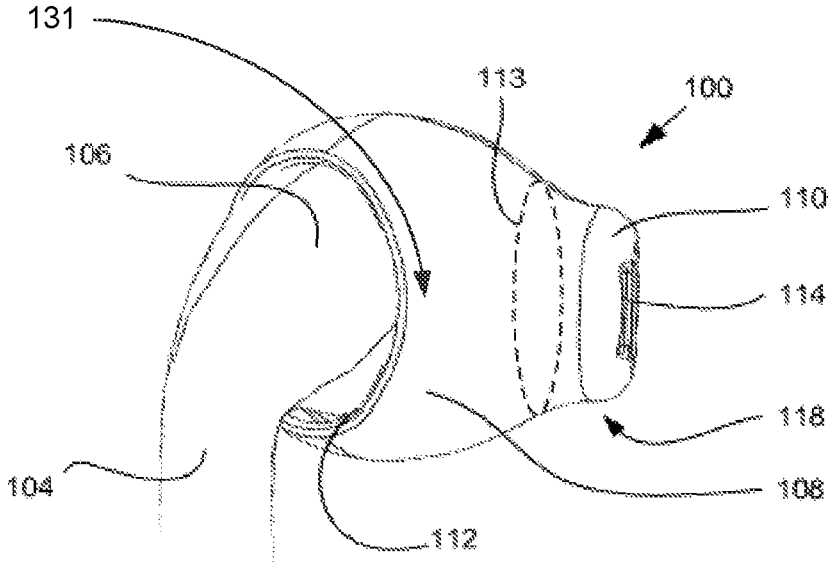
FIG. 1A is a rear oblique view of a cover on an earphone according to one embodiment of the invention.

In accordance with common practice the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION

According to some embodiments there is provided a flexible earphone cover that has a flexible main body and a flexible nose cone or ear cone (referred to herein as "ear cone") that extends from the main body. Earphones, as used herein, refers to any in-ear audio devices. The flexible main body is configured to substantially encase a portion of an earphone. The flexible main body defines an internal cavity for receiving the earphone. It also defines a first opening at a side of the cavity for receiving the earphone there-through. The flexible main body defines a second opening at a side of the cavity. The second opening is smaller than the first opening. Finally, the flexible main body defines a third opening at a side of the cavity. The third opening is smaller than the first opening and the second opening. The flexible ear cone defines a converging passageway from the second opening to an exit configured to direct sound into an ear canal of a user.

Some embodiments also provide a method for making a flexible earphone cover. Initially, an elastomer or other suitable material is injection or compression molded into a mold to integrally form the flexible main body and ear cone described herein. In some embodiments, the earphone cover is made from an elastomer that is injection molded into an injection port or gate disposed within the internal cavity. In some embodiments, the material has a color, is translucent, includes reflective particles, is semi-transparent, is completely transparent, and/or glows in the dark. Where the material is a glow in the dark material, the material may include about 25 percent of a phosphorescent based material.

The main body material (e.g., an elastomer, polymer, or polyurethane) and the thickness of the main body are selected so that the main body is compliant and elastic. In some embodiments, the covers disclosed herein (including the covers 100 and 130) are made from silicone based materials that are compression molded. This together with the shape of the main body and ear cone allows the cover to snuggly fit within most, if not all, adult wearer's ears. This also allows the cover (and earphone) to be comfortably worn for long periods of time. This design also results in a cover (and earphone) that does not slip-out of the wearer's ears when the wearer is moving, such as during exercise. This snug fit also prevents some ambient noise from entering the user's ear canal, thereby improving the listening experience, and allowing the user to play the audio at a lower volume.

Other embodiments provide a method for coupling the earphone cover to an earphone. Initially, a cover, as described herein, is provided. The first opening of the flexible main body is then stretched over the appropriate left or right head of the earphone (or the appropriate earphone is inserted into the first opening). In some embodiments, the cover is then manipulated so that the third opening of flexible main body is aligned with a treble hole in the earphone. In other embodiments, the cover is manipulated so that the third opening of flexible main body is aligned with another hole in the earphone, should one exist. In some embodiments, the cover is manipulated so that the fourth opening and/or the fifth opening of the flexible main body is aligned with one or more holes for sensors in the earphone. In some embodiments, the flexible main body is pulled behind the earphone head to remove any wrinkles or blisters on the surface of the cover. Also in some embodiments, the ear cone is aligned with the main speaker outlet on the earphone head. The earphone and cover can then be inserted into the appropriate left or right outer ear canal of the user with the ear cone directed down the user's ear canal. Audio can then be played through the earphones to be heard by the user.

Figure 1B:
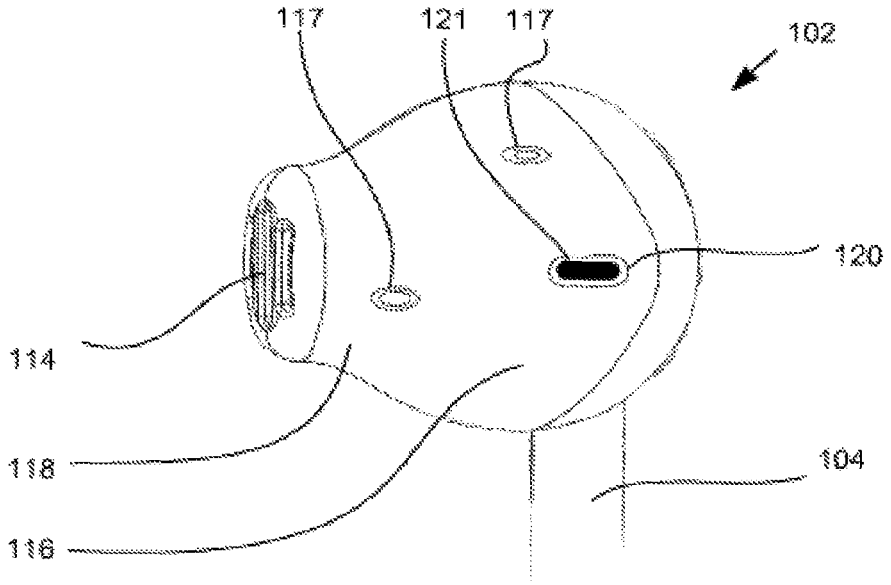
FIG. 1B is a front oblique view of the cover shown in FIG. 1A.
Figure 2:
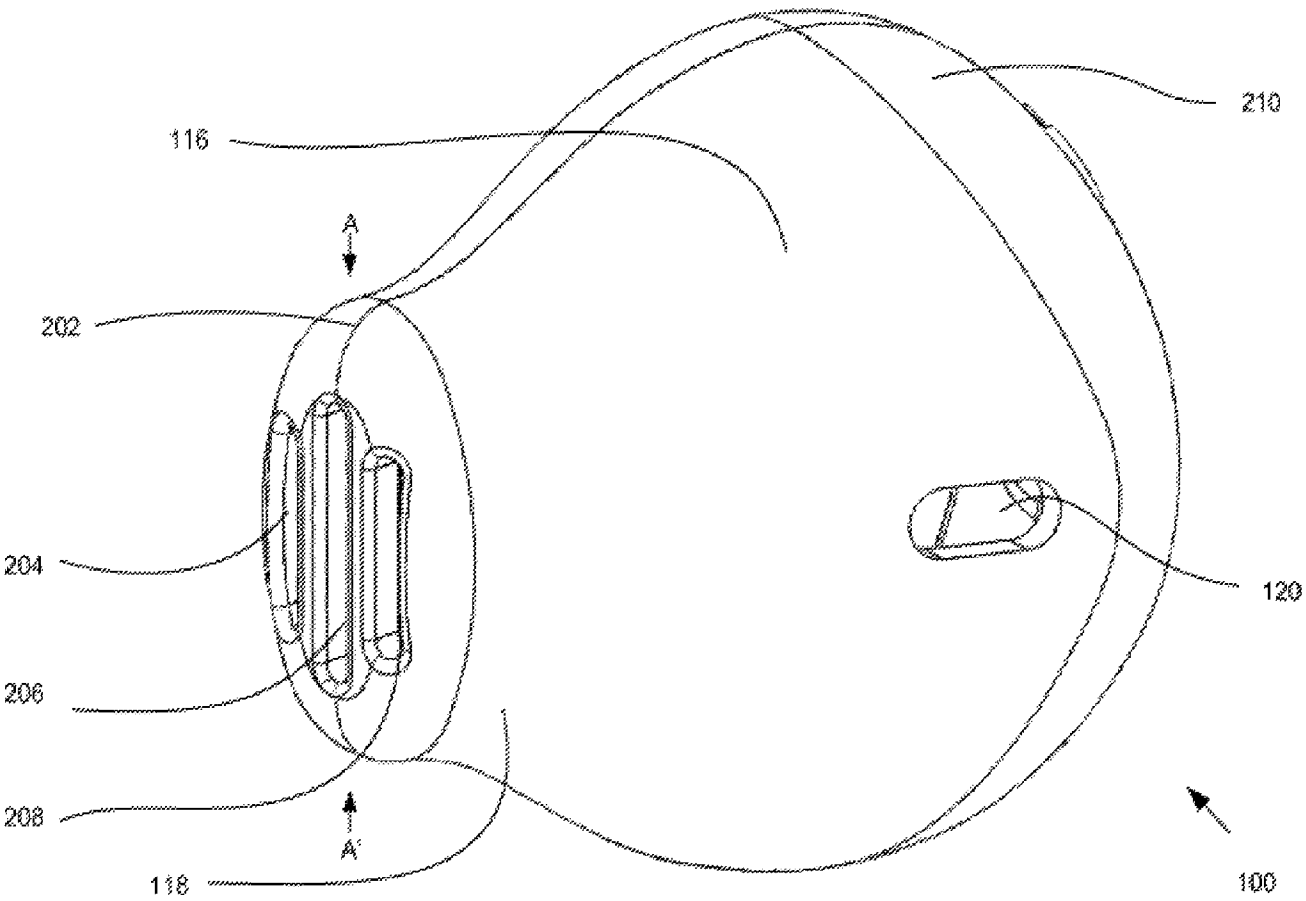
FIG. 2 is a front oblique view of the cover shown in FIGS. 1A and 1B, but here the cover is shown not coupled to an earphone.

FIG. 1A is a rear oblique view of a cover 100 shown coupled to an earphone according to one embodiment of the invention. FIG. 1B is a front oblique view of the cover and earphone shown in FIG. 1A. The cover 100 is configured to be removably coupled to the earphone. FIG. 2 is a front oblique view of the cover shown in FIGS. 1A and 1B, but here the cover 100 is shown on its own, i.e., not coupled to an earphone.

Figure 3:
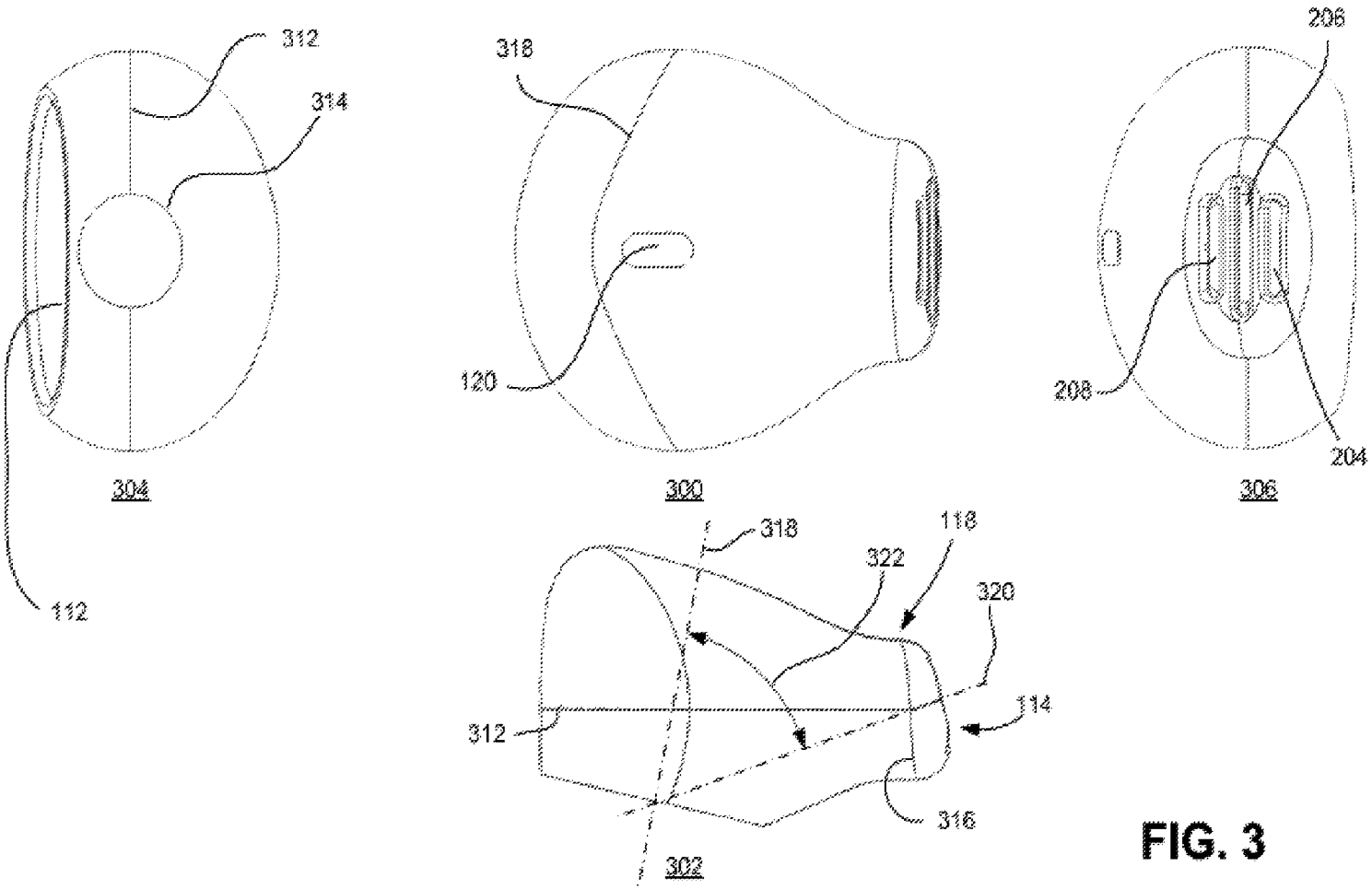
FIG. 3 shows top, side, front, and back views of the cover shown in FIGS. 1A, 1B, and 2.
Figure 4:
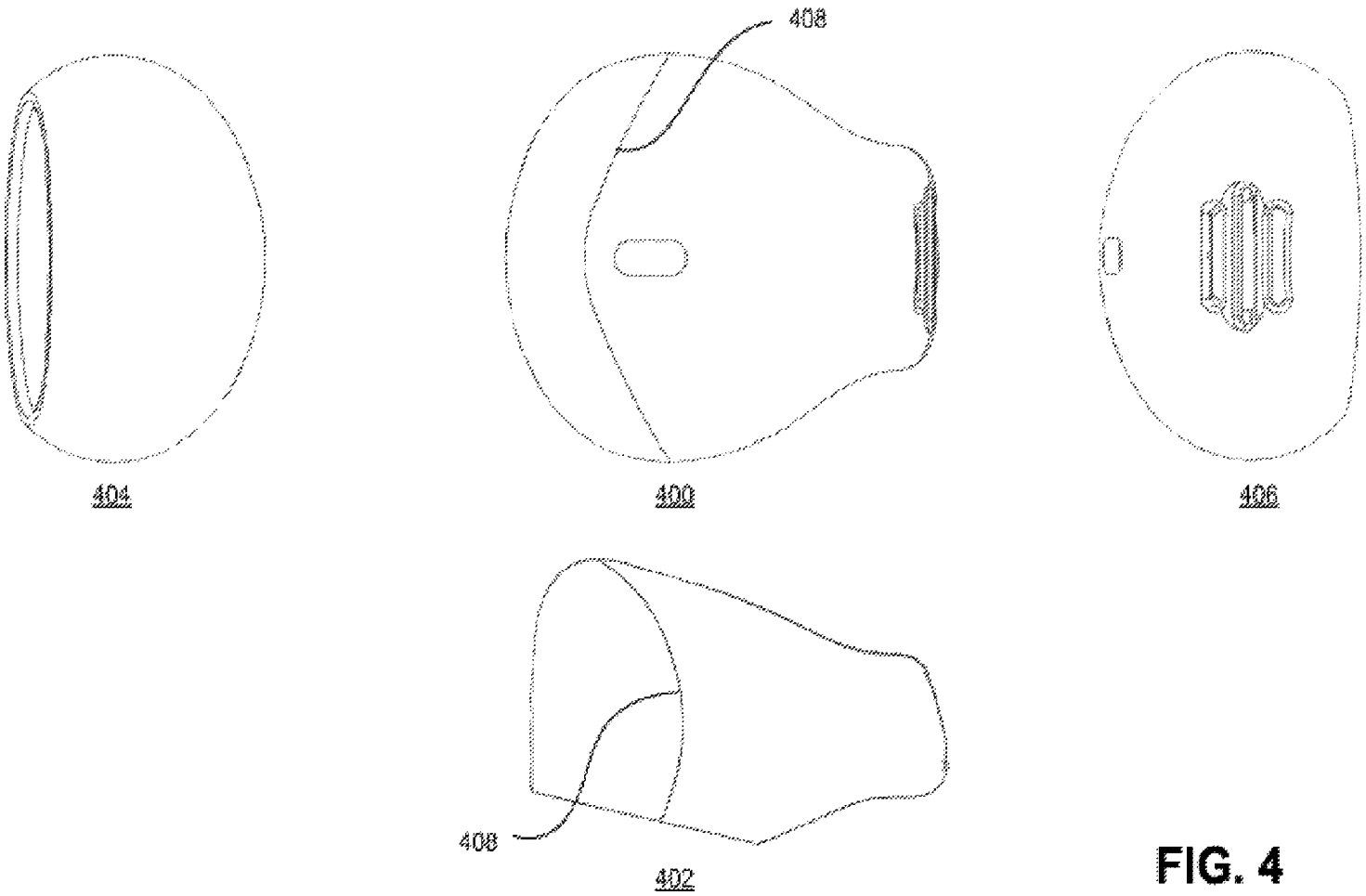
FIG. 4 shows top, side, front, and back views of a cover according to another embodiment of the invention.

In some embodiments, the earphone includes a head 106 connected to a neck or stem 104. A cable (not shown) carrying electrical signals passes through the stem 104 and is connected to one or more speakers (not shown) within the head 106. In some embodiments, the cover 100 is configured to be coupled to APPLE'S EARPODS® earphone, such as the earphones shown and described in U.S. Pat. No. 691,594, and U.S. Patent Application Nos. US 20130343595 and US 20120237074. In some other embodiments, each cover 100 is configured to be coupled to an APPLE AIRPODS™ earphone, such as the earphone shown and described in U.S. patent application Ser. Nos. 15/171,310, 15/172,070, and 15/273,655. The contents of the aforementioned patent and patent applications are hereby incorporated by reference in their entirety. Other suitable earphones may include different configurations, such as an earphone with no stem, a wireless earphone that include wireless (such as BLUETOOTH) circuitry, or the like. It should also be noted that the separate and distinct covers 100 are provided for a left earphone and a right earphone. FIG. 1A shows a cover and earphone for a right ear, but a cover having a mirrored geometry is configured to fit an earphone for a left ear, as shown in FIGS. 3 and 4.

The cover 100 includes a main body 108 and an ear cone 118 that extends from the main body 108. In some embodiments, both the main body 108 and the ear cone 118 are flexible. In other embodiments, only the main body 108 is flexible. In yet other embodiments, the main body 108 is more flexible than the ear cone 118. In some embodiments, the thickness of the material of the cover is thickest around the first opening. In other embodiments, the thickness of the material of the cover is thickest at the ear cone. In other embodiments, the thickness of the material of the cover is thickest at the first opening and at the ear cone. In yet other embodiments, the thickness of the material of the cover is uniform throughout.

In some embodiments, the earphone cover 100 is made from flexible elastomer, polymer, or polyurethane using an injection molding or a compression molding process. In other embodiments, the earphone cover is made from an elastomer that does not substantially lose its grip when wet. In fact, in some embodiments, an elastomer is used that provides extra grip or friction when wet. A suitable elastomer is one that: is chemically stabile; is able to be wet with water, alcohol or another cleaner without changing the properties of the material; possesses tensile strength suitable to allow the cover to be stretched over an earphone without tearing and while maintaining the cover's original shape; absorbs and holds its color; and is resistant to weathering and wear and tear.

The main body 108 is configured to substantially encase the head of the earphone. The main body 108 defines an internal cavity for receiving and substantially encasing the head of the earphone, as shown. The main body 108 also defines a first opening 112 at one side of the internal cavity for receiving the head of the earphone there-through. In some embodiments, the first opening 112 has a circular shape. In other embodiments, the first opening 112 has an oval or oblong shape when not installed on an earphone.

The shape, size and configuration of the first opening 112 allows for a better and more secure wrapping of the cover around the earphone. In other words, the cover wraps around the earphone to stay in position and not be easily pulled off the earphone. The oval shape allows the cover to wrap around the earphone while leaving a speaker vent (not shown) on the neck or stem 104 (FIG. 1) of the earphone exposed to ambient air. To the extent that the earphone includes a speaker vent on the stem, covering the vent produces an unwanted tinny sound, as the base frequencies of the audio are not heard. For the APPLE EARPODS®, the cover 100 does not cover any vents or openings in the earphone. To the extent that the earphone includes one or more other holes, such as holes for one or more microphones (e.g., for noise cancellation) or sensors (e.g., for the APPLE AIRPODS™ earphone), covering these hole(s) may hinder the microphone's or sensor's ability to operate.

The main body 108 defines a second opening at a side of the internal cavity. As the second opening in the main body cannot be seen in these figures, as it is internal to the cover, the location of the second opening is shown by the phantom line 113. In some embodiments, the second opening 113 is smaller than the first opening 112. In some embodiments, the second opening 113 is not positioned opposite the first opening 112, but, instead, is positioned to one side of the main body 108, as shown.

In some embodiments, the main body 108 defines a third opening 120 (best seen in FIG. 1B) at a different side of the internal cavity. In some embodiments, the first opening has a stadium or generally oval geometric shape when viewed from above. The third opening 120 is smaller than the first opening 112 and the second opening 113. In some embodiments, the third opening 120 is disposed roughly opposite to the first opening 112. In some embodiments, the third opening 120 is offset from a longitudinal axis (shown in FIG. 3 as reference numeral 318) formed through the center of the first opening 112. In other words, in some embodiments, the third opening 120 is not directly opposite the center of the first opening 112.

In some embodiments, the third opening 120 is configured to pass sound from the earphone into the ear of the user. In some embodiments, the third opening 120 is configured to pass sound in the treble range of frequencies from a treble hole 121 in the earphone into the ear of the user. The treble hole 121 of the speaker is also known as the front leak, which provides proper venting for a speaker driver to tune to a particular frequency range, e.g., the higher frequency portion of the frequency response. See, e.g., published U.S. patent application no. 20130343595.

In some embodiments, the flexible ear cone 118 defines a substantially converging passageway from the second opening to an exit 114. Here, the cover is configured to direct sound from the speaker in the earphone toward the exit 114, so as to direct sound into an ear canal of an ear of a user.

In some embodiments, the earphone includes one or more additional holes or vents, such as for microphones or other sensors used for noise-cancellation or for switching power ON/OFF. In these embodiments, either the third hole 120 or other holes 117 may be formed in the cover to align with the corresponding holes in the earphone. In some embodiments, these additional holes are formed in the main body 116, while in other embodiments, they are formed in the cone 118.

In some embodiments, the exit 114 includes a grill with multiple substantially parallel slots or slits. In some embodiments, there are three of these slits 204, 206, 208 (best seen in FIG. 2) that are substantially parallel to one another. These slits are relatively large so as to funnel more sound through the ear canal and allow the user to play audio at a lower volume, thereby using less power and preventing damage to the ear drum. In some embodiments, the middle slit 206 is substantially longer than the other two slits 204, 208 on either side of the middle slit. In some other embodiments, the exit 114 does not include any slots or slits. One of skill in the art should appreciate that other exit 114 configurations are possible.

Moreover, in some embodiments, the end of the ear cone 118 is angled to allow for a slightly larger exit surface area. This larger surface area allows for larger slits 204, 206, and/or 208, which, in turn, facilitates more sound passing through the slits to the user's ear canal(s) while maintaining stability. This angle is shown by reference numeral 323, and is measured between a substantially flat end portion at the end of the ear cone 118 and a line substantially parallel with a plane formed by the second hole 113 (see FIG. 1A).

The slits 204, 206, 208 on the cover 100 block unwanted material (e.g., pocket lint or earwax) from entering a recess in the earphone, thereby ensuring better sound quality. In use, the cover can be cleaned or swabbed with alcohol or water. This cleaning also prevents unwanted material caught in the earphone from transferring back into the ear of the use, thereby reducing the chance for spreading infection. The user can also squeeze the sides of the ear cone 118, as shown by arrows A, A', to enlarge or change the shape of the slits 204, 206, 208 so as to aid in removing the unwanted material from the ear cone and the slits 204, 206, 208.

Alternatively, the user can easily remove the cover 100 to clean the exit 114 and slits 204, 206, 208 from any unwanted material that has accumulated at or near the exit 114.

In some embodiments, other than the first 112, second 113, and third 120 openings, the main body 108 has no other holes formed therein. In some embodiments, the entire outer surface of the earphone cover 100 is substantially smooth with no substantial ridges or sharp edges. Also in some embodiments, the main body 108 is configured not to cover any vent holes in the earphone.

FIG. 3 shows top 300, side 302, front 306, and back 304 views of the cover 100 shown in FIGS. 1A, 1B, and 2. As is evident from these figures, the ear cone does not extend along the longitudinal axis 320. Instead, as best seen in the side view, 302, in some embodiments, the angle 322 between a longitudinal axis 318 that extends through a center of the ear cone 118 and a longitudinal axis 320 that extends through a center of the first opening 112 is between about 45 degrees and about 85 degrees. In a more preferable embodiment, this angle 322 is between about 55 degrees and about 80 degrees. In yet another preferred embodiment, this angle 322 is about 60 degrees to about 75 degrees. When inserted in the ear, the angle of the ear cone points down the ear canal and provides better stability and sound. A cone that does not have the abovementioned angles may rest against the bone, muffle the sound, and compromise the grip and/or stability. In other words, the shape and angle of the ear cone efficiently direct sound into a user's ear canal so that the user can listen to audio at a lower volume. In addition, the angle of the ear cone enables the cover to be relatively short while maintaining stability.

Also shown in FIG. 3 are a number of mold parting lines 312, 314, 316, 318. These lines are formed where different sections of the mold used to form the cover join together. Different embodiments include more or less of these lines 312, 314, 316. In the case of line 318, the mold sections are specifically designed to provide an aesthetically pleasing curve that skirts the third opening 120, as shown.

FIG. 4 shows top 400, side 402, front 406, and back 404 views of a cover according to another embodiment of the invention. Here there is only a single mold parting line 408

(similar to line 318 in FIG. 3) and the cover is formed from only two mold sections that join together at line 408.

Figure 5:
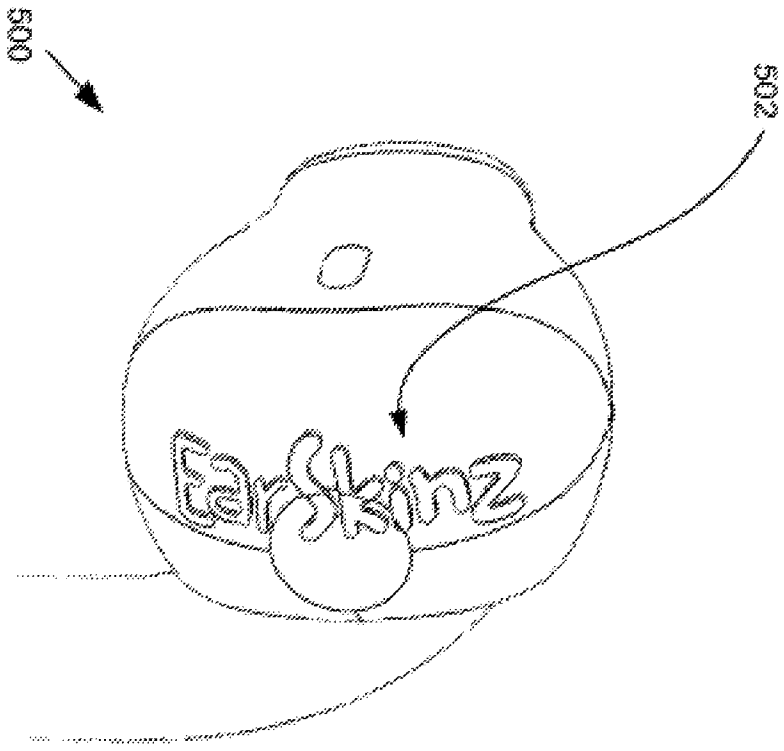
FIG. 5 shows a rear oblique view of a cover on an earphone according to yet another embodiment of the invention.

FIG. 5 shows a rear oblique view of a cover 500 on an earphone according to yet another embodiment of the invention. Here, a logo 502 is integrally formed into the cover at the time of injection or compression molding. In some embodiments, the logo is either silkscreen printed on the cover 500 or built into the mold to be formed on the cover at the time of injection or compression molding. In some embodiments, this logo is formed at the rear or back of the cover, as shown. In some alternative embodiments, for example when foam materials are used for making the cover, no logo is included on the cover 500.

In some embodiments, the mold used to make the cover includes one or more vents (e.g., at or around the ear or nose cone) to facilitate flow of material into the entire mold, i.e., to completely fill the mold.

Figure 6A:
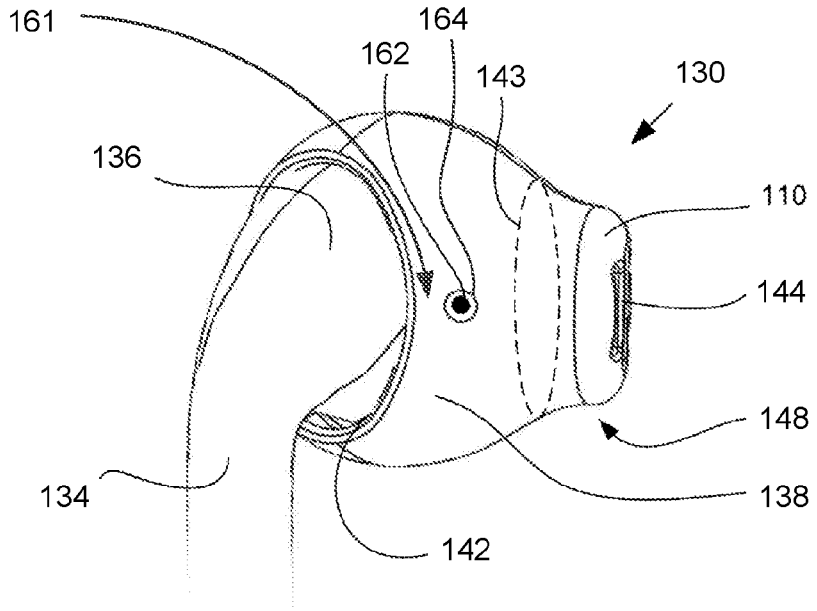
FIG. 6A is a rear oblique view of a cover coupled to an earphone including one or more sensors according to one embodiment of the invention.
Figure 6B:
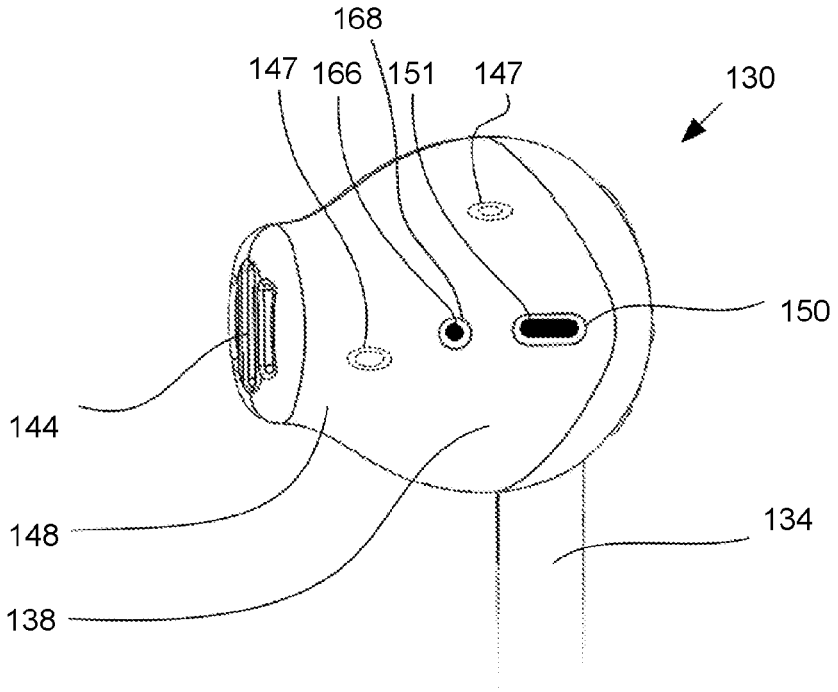
FIG. 6B is a front oblique view of the cover coupled to an earphone including one or more sensors shown in FIG. 6A according to one embodiment of the invention.
Figure 7:
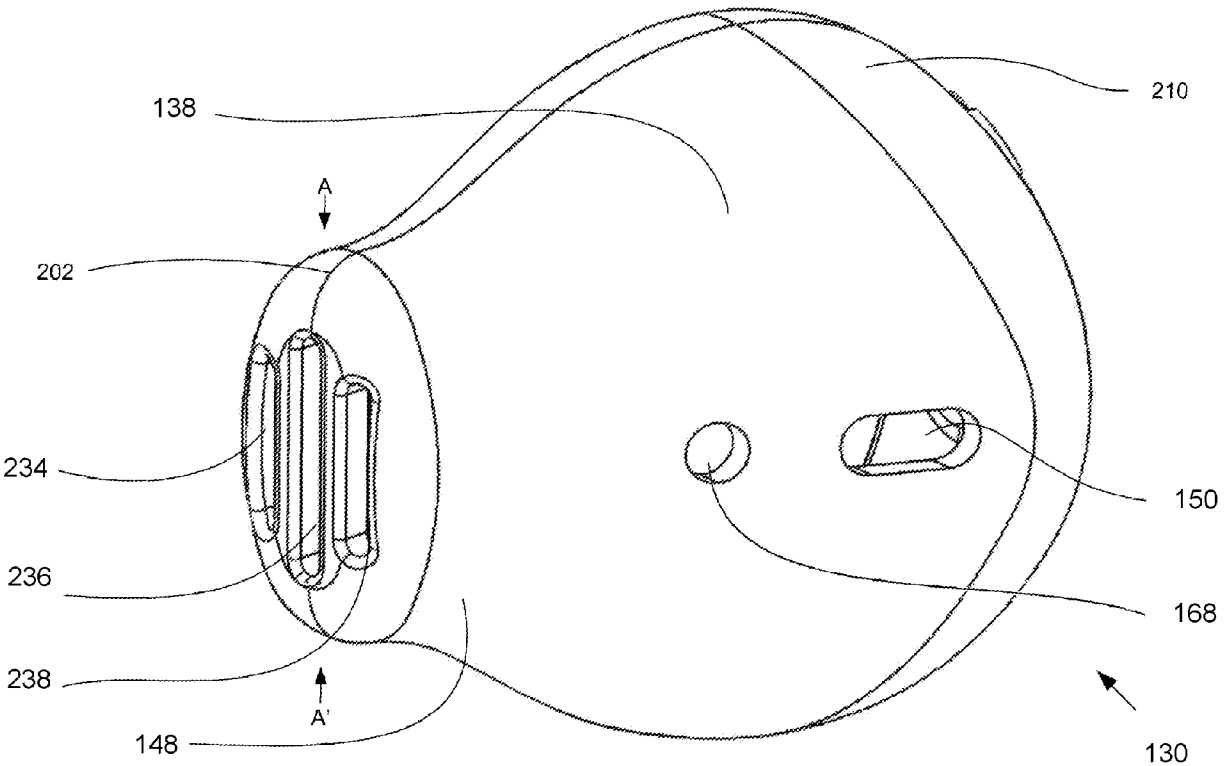
FIG. 7 is a front oblique view of the cover shown in FIGS. 6A and 6B, without coupling to an earphone according to one embodiment of the invention.

FIG. 6A is a rear oblique view of a cover 130 shown coupled to an earphone according to one embodiment of the invention. FIG. 6B is a front oblique view of the cover 130 and earphone shown in FIG. 6A. The cover 130 is configured to be removably coupled to the earphone. FIG. 7 is a front oblique view of the cover shown in FIGS. 6A and 6B, but here the cover 130 is shown on its own, i.e., not coupled to an earphone.

Figure 8:
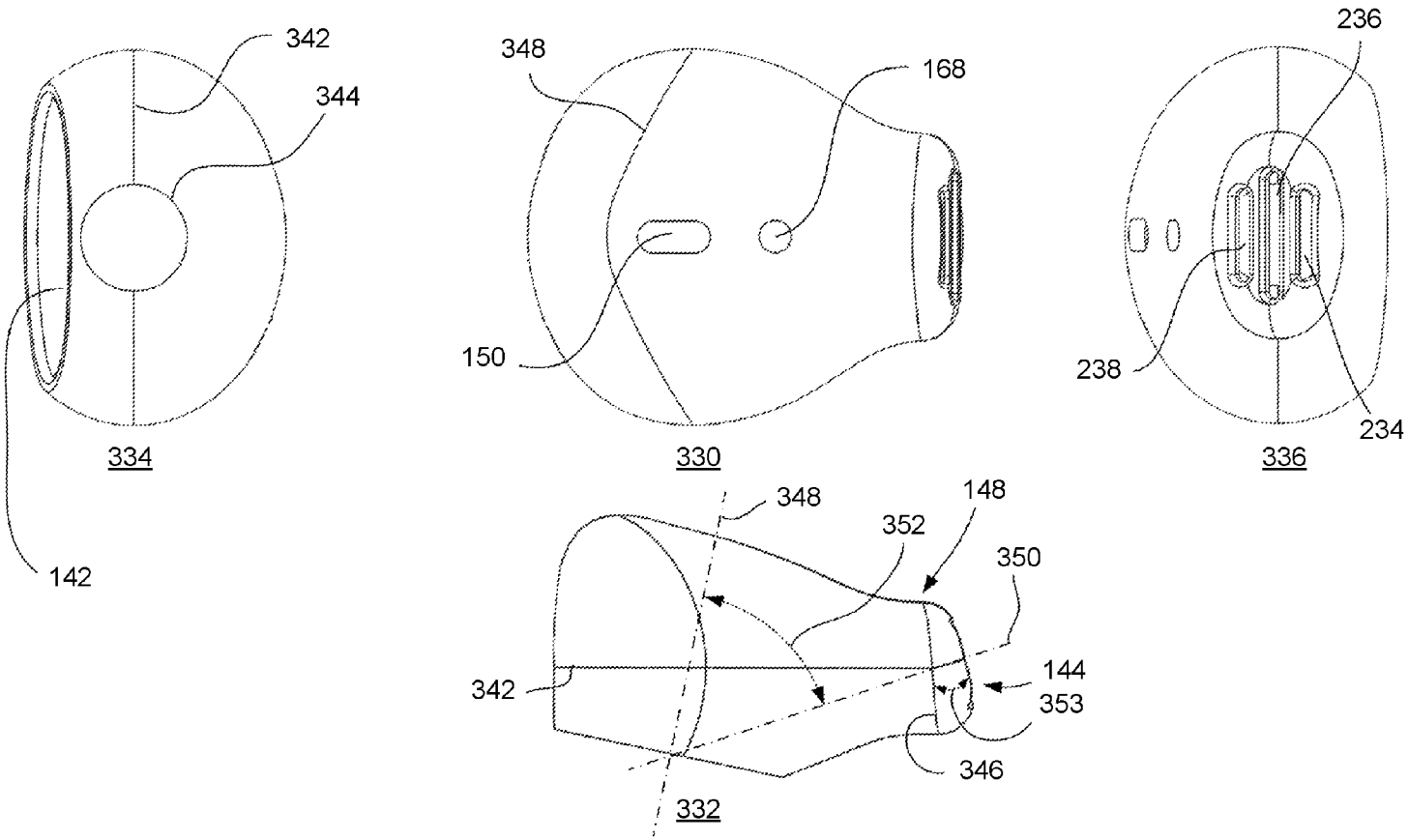
FIG. 8 shows main body side, front, ear cone side, and side views of the cover shown in FIGS. 6A, 6B, and 7.
Figure 9:
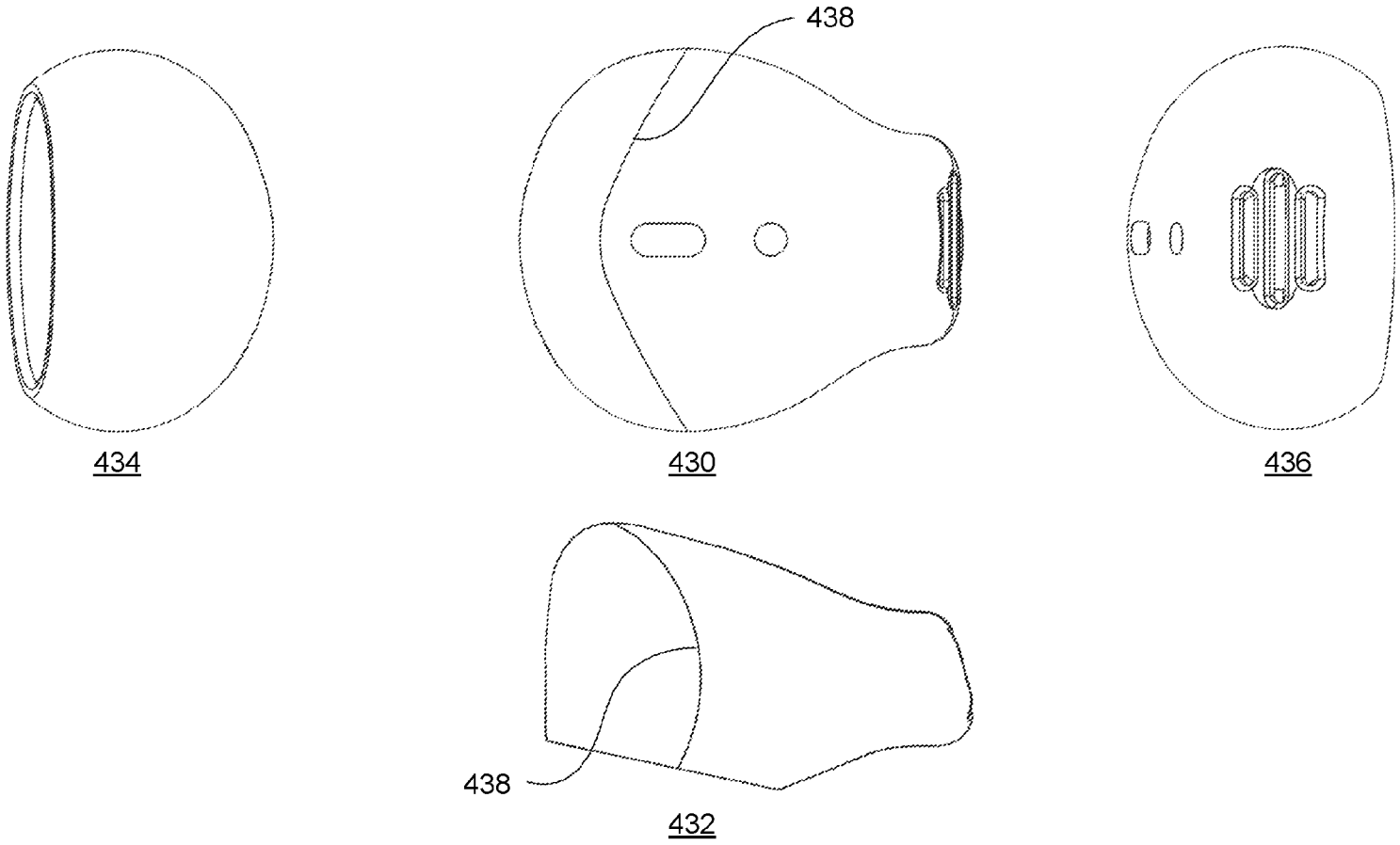
FIG. 9 shows main body side, front, ear cone side, and side views of a cover according to another embodiment of the invention.
Figure 11:
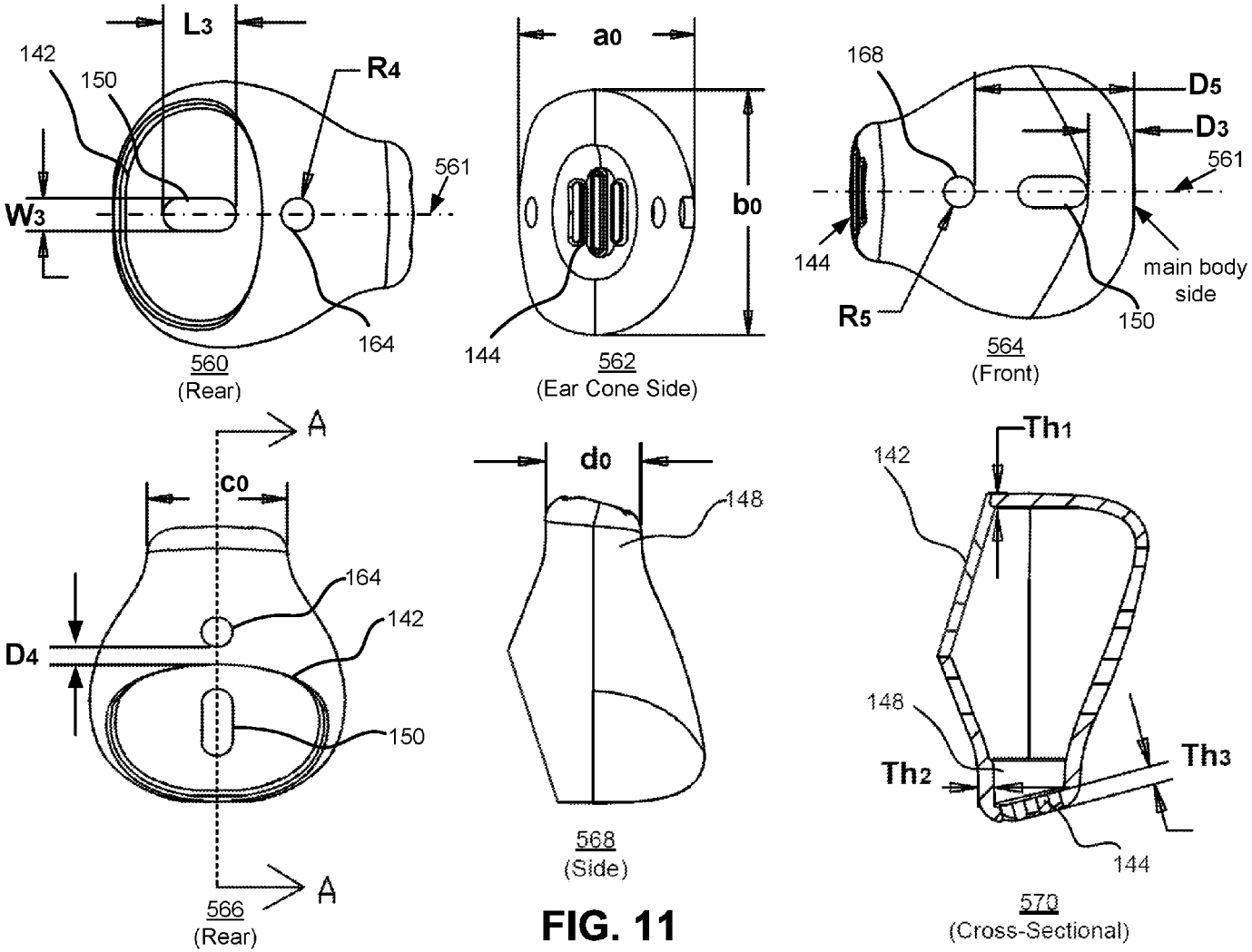
FIG. 11 shows rear, ear cone side, front, side, and cross-sectional views of a cover according to one embodiment of the invention.

In some embodiments, the earphone includes a head 136 connected to a neck or stem 134. A cable (not shown) carrying electrical signals passes through the stem 134 and is connected to one or more speakers (not shown) within the head 136. In some embodiments, each cover 130 is configured to be coupled to an APPLE EARPODS® earphone, such as the earphones shown and described in U.S. Pat. No. 691,594, and U.S. Patent Application Nos. US 20130343595 and US 20120237074. In some other embodiments, each cover 130 is configured to be coupled to an APPLE AIRPODS™ earphone, such as the earphone shown and described in U.S. patent application Ser. Nos. 15/171,310, 15/172,070, and 15/273,655. The contents of the aforementioned patent and patent applications are hereby incorporated by reference in their entirety. For example, the earphones may include different configurations, such as an earphone with no stem, a wireless earphone that include wireless (such as BLUETOOTH) circuitry, an earphone including one or more sensors, or the like. It should also be noted that the separate and distinct covers 130 are provided for a left earphone and a right earphone. FIGS. 6A, 6B, and 11 show a cover and earphone for a right ear, but a cover having a mirrored geometry is configured to fit an earphone for a left ear, as shown in FIGS. 8 and 9.

The cover 130 includes a main body 138 and an ear cone 148 that extends from the main body 138. In some embodiments, both the main body 138 and the ear cone 148 are flexible. In other embodiments, only the main body 138 is flexible. In yet other embodiments, the main body 138 is more flexible than the ear cone 148. In some embodiments, the thickness of the material of the cover is thickest around a first opening 142. In other embodiments, the thickness of the material of the cover is thickest at the ear cone 148. In other embodiments, the thickness of the material of the cover is thickest at the first opening 142 and at the ear cone 148. In yet other embodiments, the thickness of the material of the cover is uniform throughout.

In some embodiments, the earphone cover 130 is made from flexible elastomer, polymer, or polyurethane using an injection molding or a compression molding process. In other embodiments, the earphone cover is made from an elastomer, polymer, or polyurethane that does not substantially lose its grip when wet. In fact, in some embodiments, an elastomer, polymer, or polyurethane is used that provides extra grip or friction when wet. A suitable elastomer is one that: is chemically stabile; is able to be wet with water, alcohol or another cleaner without changing the properties of the material; possesses tensile strength suitable to allow the cover to be stretched over an earphone without tearing and while maintaining the cover's original shape; absorbs and holds its color; and is resistant to weathering and wear and tear.

The main body 138 is configured to substantially encase the head of the earphone. The main body 138 defines an internal cavity for receiving and substantially encasing the head of the earphone, as shown. The main body 138 also defines the first opening 142 at one side of the internal cavity for receiving the head of the earphone there-through. In some embodiments, the first opening 142 has a circular shape. In other embodiments, the first opening 142 has an oval or oblong shape when not installed on an earphone.

The shape, size and configuration of the first opening 142 allows for a better and more secure wrapping of the cover around the earphone. In other words, the cover wraps around the earphone to stay in position and not be easily pulled off the earphone. The oval shape allows the cover to wrap around the earphone while leaving a speaker vent (not shown) on the neck or stem 134 (FIGS. 6A-6B) of the earphone exposed to ambient air. To the extent that the earphone includes a speaker vent on the stem, covering the vent produces an unwanted tinny sound, as the base frequencies of the audio are not heard. For the APPLE EARPODS® earphone or AIRPODS™ earphone, the cover 130 does not cover any vents or openings in the earphone. To the extent that the earphone includes one or more other holes, such as holes for one or more microphones (e.g., for noise cancellation) or sensors (e.g., sensor 162 and/or sensor 166), covering these hole(s) may hinder the microphone's or sensor's ability to operate or to function properly. In some embodiments, one or more sensors of the earphone include one or more hall sensors to detect proximity, one or more optical sensors (e.g., infrared sensors), or any other suitable types of sensors. In some embodiments, the one or more sensors are used to sense whether the earphone has been inserted into a user's ear, e.g., by detecting whether the one or more sensors are close to or touching a part of the user's ear.

The main body 138 defines a second opening at a side of the internal cavity. As the second opening in the main body cannot be seen in these figures, as it is internal to the cover, the location of the second opening is shown by the phantom line 143. In some embodiments, the second opening 143 is smaller than the first opening 142. In some embodiments, the second opening 143 is not positioned opposite the first opening 142, but, instead, is positioned to one side of the main body 138, as shown.

In some embodiments, the main body 138 defines a third opening 150 (best seen in FIG. 6B) at a different side of the internal cavity. In some embodiments, the third opening has a stadium or generally oval geometric shape when viewed from above. The third opening 150 is smaller than the first opening 142 and the second opening 143. In some embodiments, the third opening 150 is disposed roughly opposite to the first opening 142 (e.g., FIG. 6A). In some embodiments, the third opening 150 is offset from a longitudinal axis (shown in FIG. 8 as reference numeral 348) formed through the center of the first opening 142. In other words, in some embodiments, the third opening 150 is not directly opposite the center of the first opening 142.

In some embodiments, the third opening 150 is configured to pass sound from the earphone into the ear of the user. In some embodiments, the third opening 150 is configured to pass sound in the treble range of frequencies from a treble hole 151 in the earphone into the ear of the user. The treble hole 151 of the speaker is also known as the front leak, which provides proper venting for a speaker driver to tune to a particular frequency range, e.g., the higher frequency portion of the frequency response. See, e.g., published U.S. patent application no. 20130343595.

In some embodiments, the flexible ear cone 148 defines a substantially converging passageway from the second opening to an exit 144. Here, the cover is configured to direct sound from the speaker in the earphone toward the exit 144, so as to direct sound into an ear canal of an ear of a user.

In some embodiments, the main body 138 defines a fourth opening 164 that is located near the first opening 142. For example, the fourth opening 164 is located next to the first opening 142 as shown in FIG. 6A. In some embodiments, the fourth opening 164 is located on the same side of the internal cavity as the first opening 142. In some embodiments, the fourth opening 164 is located between the first opening 142 and the second opening 143.

In some embodiments, the main body 138 defines a fifth opening 168 that is located near the third opening 150. In some embodiments, the fifth opening 168 is located on the same side of the internal cavity as the third opening 150. For example, the fifth opening 168 is located next to the third opening 150 as shown in FIG. 6B. In some embodiments, and as shown in FIGS. 6B and 8, the third opening 150 is located between the fifth opening 168 and the parting line (or the longitudinal axis) 348. In some embodiments as shown in FIGS. 6A and 6B, the fourth opening 164 and the fifth opening 168 are located on two different sides of the main body 138 (or the internal cavity) and have substantially similar (or identical) distances from the exit 144.

In some embodiments, the fourth opening 164 and the fifth opening 168 are identical in shape and size. For example, each of the fourth opening 164 and the fifth opening 168 has a circular shape, an oval shape, or any other suitable shape. In some embodiments, the fourth opening 164 and the fifth opening 168 have shapes that match (e.g., are substantially identical to) the shapes of the holes in the earphones for the sensors 162 and 166, respectively. In some embodiments, each of the fourth opening 164 and the fifth opening 168 is smaller than the third opening 150, which is smaller than the first opening 142 and the second opening 143. Alternatively, the fourth opening 164 and the fifth opening 168 have different shapes and/or sizes, e.g., that match distinct shapes and/or sizes of holes in the earphones for different types of sensors.

In some embodiments, the fourth opening 164 and the fifth opening 168 are configured to pass signals transmitted to and from one or more sensors (e.g., sensor 162 and sensor 166, respectively) located on each earphone. Covering these sensors (e.g., entirely or partially) may hinder or block the sensor's ability to operate. In some embodiments, the sensor 162 (FIG. 6A) and the sensor 166 (FIG. 6B) are distributed on different sides of the main body of the earphone. In some embodiments, the sensors 162 and 166 are used for detecting a wear status of the earphones, i.e., whether each earphone has been inserted into a user's ear, e.g., by detecting whether the sensors 162 and 166 are close to or touching the tragus and the concha, respectively, of the user's ear. [The sensors may be hall sensors to detect proximity, optical sensors (e.g., infrared sensors), or any other suitable types of sensors. Accordingly, the fourth opening 164 and the fifth opening 168 are configured to expose (e.g., support, pass, not to block or hinder functioning of) the sensors 162 and 166, respectively, such that the sensors can function properly, i.e., sensing whether the earphone has been inserted into the user's ear.

In some embodiments, the sizes of the one or more openings on the earphone, e.g., the third opening 150, the fourth opening 164, and/or the fifth opening 168, have certain clearance with respect to the sizes of the corresponding holes, e.g., the treble hole and/or holes for corresponding sensors, on the earphone to accommodate for misalignment when the user applies the cover to the earphone. For example, even if the cover is not put on the earphone perfectly, the one or more openings will not block the corresponding holes on the earphone. For example, the openings on the cover made by a compression molding method can expose the corresponding holes entirely on the earphone to ensure that the treble sound can pass the opening without any loss and the sensors can function properly. In some embodiments, each opening 164 or 168 has a diameter that is 0.2 mm to 1 mm larger (i.e., a clearance of 0.1 mm to 0.5 mm on each side of the opening) than the diameter of the corresponding sensor hole on the earphone. In some embodiments, the length and/or the width of the third opening 150 is 0.2 mm to 1 mm larger than the length and/or the width, respectively, of the treble hole on the earphone. In some other embodiments, after the cover is put on the earphone, the one or more openings expose the corresponding holes partially (e.g., with an overlap of 0.2 mm-0.5 mm between an opening and a corresponding hole on the earphone). In such situation, the treble sound may still pass the opening without any loss and the sensors may still function properly.

In some embodiments, the main body 138, the first opening 142, the second opening 143, the third opening 150, and the ear cone 148 of the cover 130 as discussed with reference to FIGS. 6A-6B, 7, 8, 9, and 10 are substantially similar to the main body 108, the first opening 112, the second opening 113, the third opening 120, and the ear cone 118, respectively, of the cover 100 as discussed with reference to FIGS. 1A-1B, 2, 3, 4, and 5. The only differences between the cover 130 and the cover 100 are in that the cover 130 includes two additional openings, i.e., the fourth opening 164 and the fifth opening 168 as shown in FIGS. 6A-6B.

In some embodiments, as discussed elsewhere herein, the cover 130 and the cover 100 are used to work with earphones with different designs, e.g., having different numbers of sensors, holes, and/or vents distributed on the earphones. In some embodiments, in order to provide sufficient area for the cover 130 to accommodate the fourth opening 164 for the sensor 162 of the earphone, more materials are used for fabricating the area around the first opening 142 of the cover 130 than those for the area around the first opening 112 of the cover 100. For example compared to the portion 131 around the first opening 112 (e.g., FIG. 1A), the portion 161 around the first opening 142 (e.g., FIG. 6A) extends longer (e.g., by 0.2 mm to 1 mm) toward the stem 134 to cover more area of the head 136, such that the cover 130 (e.g., the main body 138) has sufficient area to accommodate the fourth opening 164 for the sensor 162 (e.g., the first opening 142 will not overlap or interfere with the fourth opening 164 or the hole for the sensor 162 in the earphone). In some embodiments, the first opening 142 and the first opening 112 are both in oval shape, and the materials around the first opening 142 and the first opening 112 have substantially similar thickness. In some embodiments, more materials are provided to the area around the first opening 142 such that the thickness of the materials around the first opening 142 is thicker for the cover 130 compared to the thickness of the materials around the first opening 112 of the cover 100.

In some embodiments, the earphone further includes one or more additional holes or vents, such as for microphones or other sensors used for noise-cancellation. In these embodiments, either the third opening 150, the fourth opening 164, the fifth opening 168, or other holes 147 may be formed in the cover to align with the corresponding holes in the earphone. In some embodiments, these additional holes are formed in the main body 138, while in other embodiments, they are formed in the ear cone 148.

In some embodiments, the exit 144 includes a grill with multiple substantially parallel slots or slits. In some embodiments, there are three of these slits 234, 236, 238 (best seen in FIG. 7) that are substantially parallel to one another. These slits are relatively large so as to funnel more sound through the ear canal and allow the user to play audio at a lower volume, thereby using less power and preventing damage to the ear drum. In some embodiments, the middle slit 236 is substantially longer than the other two slits 234, 238 on either side of the middle slit. In some other embodiments, the exit 144 does not include any slots or slits. One of skill in the art should appreciate that other exit 144 configurations are possible.

Moreover, in some embodiments, the end of the ear cone 148 is angled to allow for a slightly larger exit surface area. This larger surface area allows for larger slits 234, 236, and/or 238, which, in turn, facilitates more sound passing through the slits to the user's ear canal(s) while maintaining stability. This angle is shown by reference numeral 353 (FIG. 8), and is measured between a substantially flat end portion at the end of the ear cone 148 and a line substantially parallel with a plane formed by the second opening 143 (see FIG. 6A).

The slits 234, 236, 238 on the cover 130 block unwanted material (e.g., pocket lint or earwax) from entering a recess in the earphone, thereby ensuring better sound quality. In use, the cover can be cleaned or swabbed with alcohol or water. This cleaning also prevents unwanted material caught in the earphone from transferring back into the ear of the use, thereby reducing the chance for spreading infection. The user can also squeeze the sides of the ear cone 148, as shown by arrows A, A', to enlarge or change the shape of the slits 234, 236, 238 so as to aid in removing the unwanted material from the ear cone and the slits 234, 236, 238.

Alternatively, the user can easily remove the cover 130 to clean the exit 144 and slits 234, 236, 238 from any unwanted material that has accumulated at or near the exit 144.

In some embodiments, other than the first 142, second 143, third 150, fourth 164, and fifth 168 openings, the main body 138 has no other holes (or openings) formed therein. In some embodiments, the entire outer surface of the earphone cover 130 is substantially smooth with no substantial ridges or sharp edges. Also in some embodiments, the main body 138 is configured not to cover any vent holes in the earphone.

In some embodiments as discussed elsewhere herein, the earphone cover 130 or 100 is made from a flexible elastomer, polymer, or polyurethane using an injection molding or a compression molding process. In some alternative embodiments, the earphone cover 130 or 100 is made from solid foam materials, e.g., open-cell-structured foams, reticulated foams, porous foams, or low density foams. In some embodiments, when the earphone cover is made from foam materials, the earphone cover includes the first opening and the second opening, but does not include the third opening, the fourth opening, the fifth opening, or any other openings. The porous foam materials are selected to be able to let the treble sound and/or the sensor signals pass through without having physical openings on the foam cover. In some other embodiments, when denser foam materials are used for fabricating the earphone covers, the earphone cover 100 includes the third opening for the treble hole (or other suitable openings) in the earphone, and the earphone cover 130 includes the third opening for the treble hole and the fourth and fifth openings for the sensor holes (or other suitable openings) in the earphone.

FIG. 8 shows main body side 334, front 330, ear cone side 336, and side 332 views of the cover 130 shown in FIGS. 6A, 6B, and 7. As is evident from these figures, the ear cone 148 does not extend along the longitudinal axis 350. Instead, as best seen in the side view 332, in some embodiments, the angle 352 between a longitudinal axis 348 that extends through a center of the ear cone 148 and a longitudinal axis 350 that extends through a center of the first opening 142 is between about 45 degrees and about 85 degrees. In a more preferable embodiment, this angle 352 is between about 55 degrees and about 80 degrees. In yet another preferred embodiment, this angle 352 is about 60 degrees to about 75 degrees. When inserted in the ear, the angle of the ear cone points down the ear canal and provides better stability and sound. A cone that does not have the abovementioned angles may rest against the bone, muffle the sound, and compromise the grip and/or stability. In other words, the shape and angle of the ear cone efficiently direct sound into a user's ear canal so that the user can listen to audio at a lower volume. In addition, the angle of the ear cone enables the cover to be relatively short while maintaining stability.

Also shown in FIG. 8 are a number of mold parting lines 342, 344, 346, 348. These lines are formed where different sections of the mold used to form the cover join together. Different embodiments include more or less of these lines 342, 344, 346. In the case of line 348, the mold sections are specifically designed to provide an aesthetically pleasing curve that skirts the third opening 150, as shown.

FIG. 9 shows main body side 434, front 430, ear cone side 436, and side 432 views of a cover according to another embodiment of the invention. Here there is only a single mold parting line 438 (similar to line 348 in FIG. 8) and the cover is formed from only two mold sections that join together at line 438.

Figure 10:
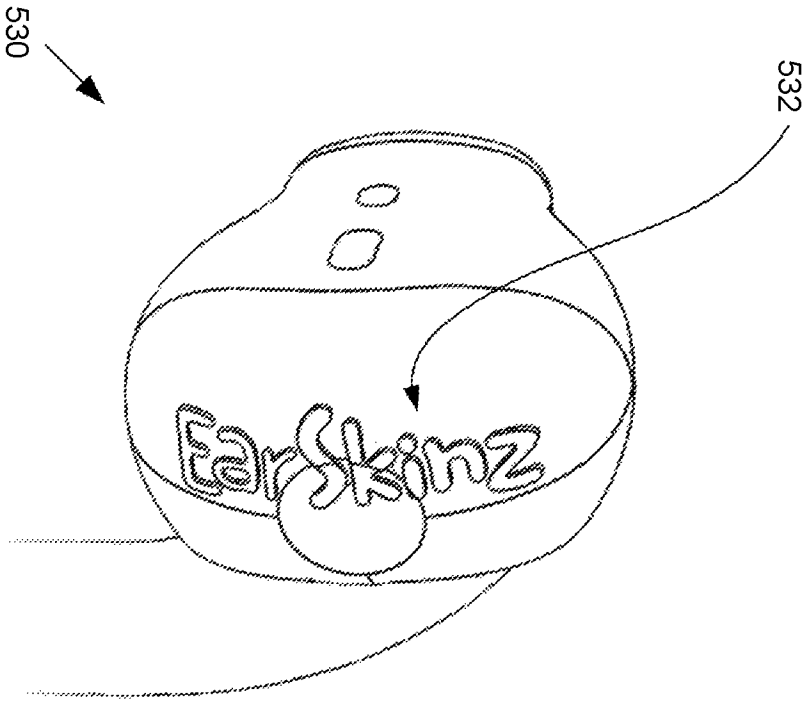
FIG. 10 shows an oblique view of a cover coupled to an earphone according to yet another embodiment of the invention.

FIG. 10 shows an oblique view of a cover 530 on an earphone according to yet another embodiment of the invention. Here, a logo 532 is integrally formed into the cover at the time of injection or compression molding. In some embodiments, the logo is either silkscreen printed on the cover 500 or built into the mold to be formed on the cover at the time of injection or compression molding. In some embodiments, this logo is formed at the rear or back of the cover, as shown. In some alternative embodiments, for example when foam materials are used for making the cover, no logo is included on the cover 530.

In some embodiments, the mold used to make the cover includes one or more vents (e.g., at or around the ear or nose cone) to facilitate flow of material into the entire mold, i.e., to completely fill the mold.

FIG. 11 shows rear views 560 and 566, ear cone side view 562, front view 564, side view 568, and cross-sectional view 570 of the cover 130 according to one embodiment of the invention. In some embodiments, the overall size, the third opening size, and/or the thickness of the materials of the cover 100 are substantially similar as the corresponding dimensions of the cover 130 as discussed in FIG. 11.

In some embodiments as shown in the rear view 560, a length $L_3$ of the third opening 150 is in a range from about 3.5 mm to 5.5 mm, and a width $W_3$ of the third opening 150 is in a range from about 1 mm to about 3 mm. In some preferred embodiments, the length $L_3$ is in a range from 4.3 mm to 4.7 mm, and the width $W_3$ is in a range from 1.8 mm to 2.2 mm. In some embodiments, a diameter $R_4$ of the fourth opening 164 is in a range from about 0.5 mm to about 1.5 mm. In some preferred embodiments, the diameter $R_4$ is in a range from 0.9 mm to 1.1 mm. In some embodiments, the third opening 150 and the fourth opening 164 are aligned along a central axis 561 as shown in the rear view 560.

In some embodiments as shown in the ear cone side view 562, a total thickness $a_0$ of the cover 130 from front to rear is in a range from about 10 mm to about 13.5 mm, and a total height $b_0$ of the cover 130 from one side to the opposite side is in a range from about 15 mm to about 18 mm. In some preferred embodiments, the total thickness $a_0$ is in a range from 11.6 mm to 12 mm, and the total height $b_0$ is in a range from 16.2 mm to 16.6 mm.

In some embodiments as shown in the front view 564, a diameter $R_5$ of the fifth opening 168 is in a range from about 0.5 mm to about 1.5 mm. In some preferred embodiments, the diameter $R_5$ is in a range from 0.9 mm to 1.1 mm. As discussed elsewhere herein, in some embodiments, the diameter $R_4$ of the fourth opening 164 is substantially similar to the diameter $R_5$ of the fifth opening 168. Alternatively, the diameter $R_4$ of the fourth opening 164 is different from the diameter $R_5$ of the fifth opening 168. In some embodiments as discussed elsewhere herein, the length $L_3$ and the width $W_3$ of the third opening 150, the diameter $R_4$ of the fourth opening 164, and the diameter $R_5$ of the fifth opening 168 are larger than the corresponding holes on the earphone to provide clearance for accommodating misalignment when applying the cover onto the earphone. Still referring to the front view 564, in some embodiments, a distance D5 between an edge of the fifth opening 168 and the main body side of the cover 130 is in a range from about 9 mm to about 12 mm, and a distance $D_3$ between an edge of the third opening 150 and the main body side of the cover is in a range from about 2 mm to about 4 mm. In some preferred embodiments, the distance D5 is in a range from 10.2 mm to 10.6 mm, and the distance $D_3$ is in a range from 2.9 mm to 3.1 mm. In some embodiments, the third opening 150 and the fifth opening 168 are aligned along the central axis 561 as shown in the front view 564.

In some embodiments as shown in the rear view 566, a total height $c_0$ of the ear cone 148 from one side to the opposite side is in a range from about 8 mm to about 10 mm. In some preferred embodiments, the total height $c_0$ of the ear cone 148 is in a range from 8.8 mm to 9.2 mm. In some embodiments, a shortest distance $D_4$ between an edge of the fourth opening 164 and an edge of the first opening 142 is in a range from about 0.5 mm to about 1.6 mm. In some preferred embodiments, the distance $D_4$ is in a range from 1 mm to 1.3 mm.

In some embodiments as shown in the side view 568, a total width $d_0$ of the ear cone 148 from front to rear is in a range from about 4.5 mm to about 7 mm. In some preferred embodiments, the total height $d_0$ is in a range from 5.5 mm to 5.9 mm. The cross-sectional view 570 is obtained by cutting along the A-A line in the rear view 566. In some embodiments as shown in the cross-sectional view 570, the thickness of the materials of the cover 130 varies at different portions. For example, a thickness $Th_1$ of materials around the first opening 142 is in a range from about 0.65 mm to about 0.9 mm, a thickness $Th_2$ of the materials around the ear cone portion 148 is in a range from about 0.78 mm to about 1 mm, and a thickness $Th_3$ of the materials of the slits at the exit 144 is in a range from about 0.9 mm to about 1.1 mm. In some embodiments, the thickness of the materials is substantially uniform throughout the cover 130. In some embodiments, the thickness of materials of the main body varies from 0.65 mm to 4.0 mm while maintaining the shapes and proportions of the parts and openings of the cover 130. In some embodiments, the sizes of the covers vary depending on the differences of the thickness of the materials. For example, a cover made from thinner materials is smaller than a cover made from thicker materials. In some embodiments, the thickness of the materials for making the covers is pre-designed and controlled during the fabrication process to obtain larger or smaller earphone covers. In some examples, earphones coupled with covers having suitable thicknesses can fit into a case (e.g., a case shown and described in U.S. patent application Ser. Nos. 15/171,310, 15/172,070, and 15/273,655), such as a charging case, a storage case, or a carrying case for the earphones. In some other examples, a user with larger ear canal may select thicker covers to couple with the earphones, while another use with smaller ear canal may select thinner covers to couple with the earphones. In yet some other examples, a user can select covers with a first thickness to couple with the earphones to provide a tighter fit when the user is exercising, while the same user can select covers with a second thickness (e.g., the second thickness being smaller than the first thickness) to couple with the earphones to provide looser and more relaxed fit when the user is not moving. As such, a satisfying user experience can be provided by selecting the covers with suitable thicknesses.

Figure 12:
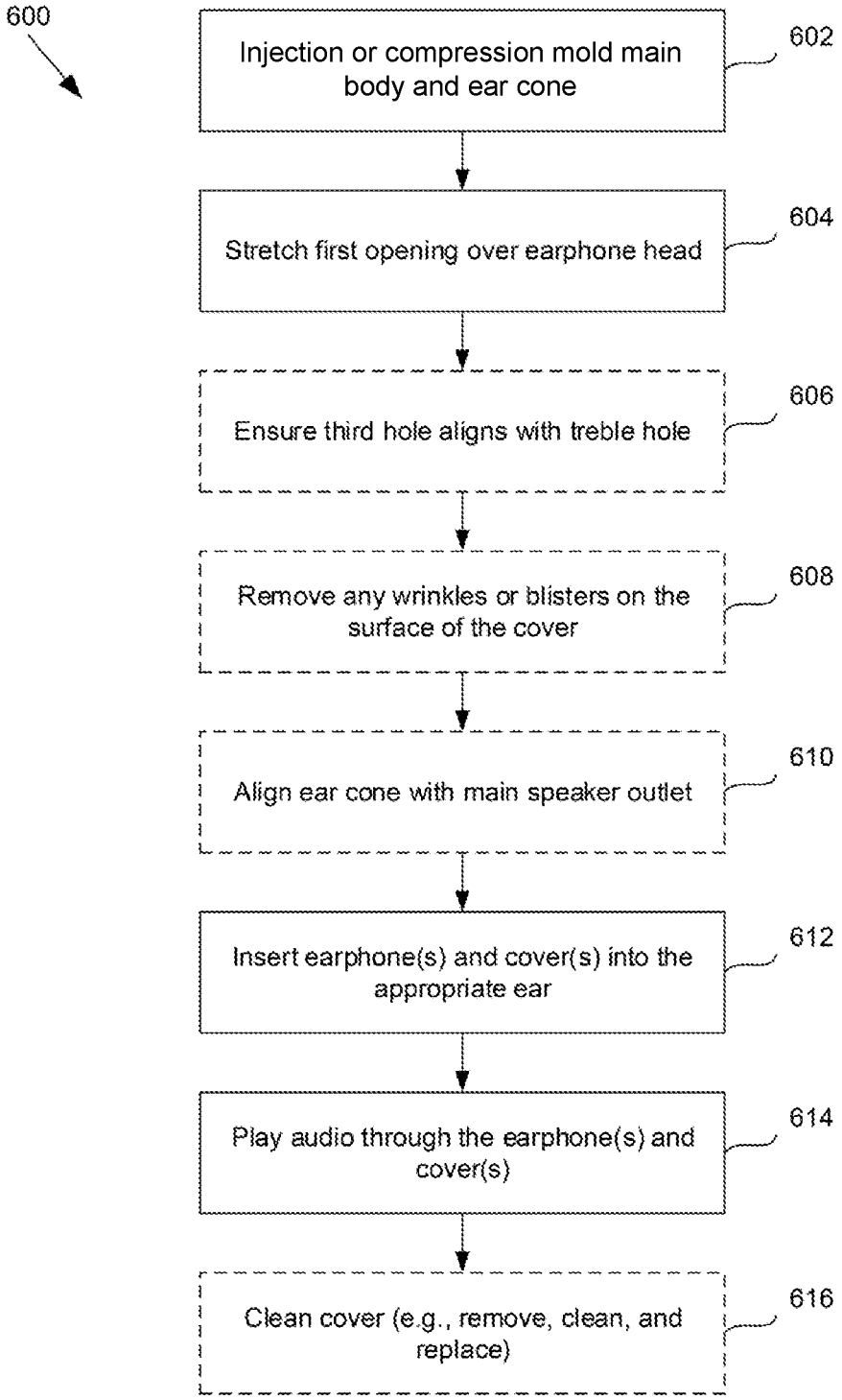
FIG. 12 is a flow chart of a method for making a cover, installing the cover on an earphone, and using the cover.

FIG. 12 is a flow chart 600 of a method for making a cover, installing the cover on an earphone, and using the cover. The method illustrated in the flow chart 600 can be used to make, install, and use the cover 100 as discussed with reference to FIGS. 1A-1B, 2, 3, 4, and 5, or the cover 130 as discussed with reference to FIGS. 6A-6B, 7, 8, 9, 10, and 11. Initially, an elastomer or other suitable material (e.g., foam material) is injection or compression molded (602) into a mold to integrally form the flexible main body and ear cone described above. In some embodiments, the main body and ear cone are integrally formed out of a material having a uniform thickness. In some embodiments, the main body and ear cone are integrally formed out of a material having a thickness that is thicker near the first opening than the remainder of the main body and ear cone. In other embodiments, the main body and ear cone are integrally formed out of a material having a thickness that is thinner near the first opening than the remainder of the main body and ear cone. In some embodiments, the earphone cover is made from an elastomer that is injection molded into an injection gate within the internal cavity so as to avoid blush on the exterior surface of the cover.

Once the user is provided with the cover, they are able to couple the cover to the earphone. To do this, the first opening of the flexible main body is stretched (604) over the appropriate left or right head of the earphone (or the appropriate earphone is inserted into the first opening). The cover is then manipulated (606) so that the third opening of flexible main body is aligned with a treble hole (or any other hole(s)) in the earphone, should any exist. In some embodiments, the cover is manipulated so that the fourth opening 164 and/or the fifth opening 168 are aligned with one or more sensors (e.g., sensors 162 and/or 166) located on the earphone. In some embodiments, the cover is designed and fabricated such that, by aligning any one or more openings of the third opening 150, the fourth opening 164, and the fifth opening 168 with the corresponding parts on the earphone (e.g., aligning the third opening 150 with a treble hole, or the fourth opening 164 and/or the fifth opening 168 with corresponding sensors), the rest of the openings can be automatically aligned with the corresponding parts of the earphone. In some embodiments as discussed elsewhere herein, the sizes of the third opening 150, the fourth opening 164, and/or the fifth opening 168 have certain clearance to accommodate for misalignment with corresponding holes, e.g., the treble hole and/or holes for corresponding sensors, when the user applies the cover to the earphone. For example, even if the cover is not put on the earphone perfectly, the one or more openings will not block the corresponding holes or hinder the functionalities of the sensors on the earphone. In some embodiments, the diameter of each opening 164 or 168 (e.g., $R_4$ or $R_5$, FIG. 11) is 0.2 mm to 1 mm larger than the diameter of the corresponding sensor hole on the earphone. In some embodiments, the length and/or the width of the third opening 150 (e.g., $L_3$ and/or $W_3$, FIG. 11) is 0.2 mm to 1 mm larger than the length and/or the width, respectively, of the treble hole on the earphone. In some embodiments, the flexible main body is pulled behind the earphone head to remove (608) any wrinkles or blisters on the surface of the cover. Also in some embodiments, the ear cone is aligned (610) with the main speaker outlet on the earphone head, and any other holes that may exist on the earphone.

The earphone and cover can then be inserted (612) into an appropriate left or right outer ear canal of the user, with the ear cone directed down the user's ear canal. In some embodiments, after inserting an earphone (e.g., an AIRPODS™ earphone) coupled with the cover 130 into the user's ear canal, the cover 130 will not block or hinder the sensing capability of the one or more sensors (e.g., sensors 162 and 166, FIGS. 6A-6B) on the earphone. The one or more sensors can detect whether the earphone, which has been coupled to the cover 130, has been inserted into the user's ear canal. In some embodiments, after it is detected that one or more earphones have been inserted into the user's ear(s), audio can then be played (614) through the earphone(s) to be heard by the user. In some examples, after coupling one cover with one earphone, mono sound can be played based on a determination that only one earphone has been inserted into the user's ear. In some other examples, after coupling a pair of covers with a pair of earphones, stereo sound can be played based on a determination that both earphones have been inserted into the user's ears. At any time, the cover can be cleaned (616) by cleaning the exit (or slits of the exit) to remove any foreign material. Alternatively, the cover can be removed, cleaned, and replaced onto the earphone.

A person skilled in the art will recognize that the invention or inventions described and claimed herein are not limited to the specific earphones described here, and instead cover all suitable earphones to which a cover may be coupled as would be understood by one skilled in the art.

It will be understood that, although the terms "first," "second," etc. may be used herein to describe various elements, these elements should not be limited by these terms. These terms are only used to distinguish one element from another. For example, a first contact could be termed a second contact, and, similarly, a second contact could be termed a first contact, without changing the meaning of the description, so long as all occurrences of the "first contact" are renamed consistently and all occurrences of the second contact are renamed consistently. The first contact and the second contact are both contacts, but they are not the same contact.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The foregoing description, for purpose of explanation, has been described with reference to specific embodiments. However, the illustrative discussions above are not intended to be exhaustive or to limit the claims to the precise forms disclosed. Many modifications and variations are possible in view of the above teachings. The embodiments were chosen and described in order to best explain principles of operation and practical applications, to thereby enable others skilled in the art.

What I claim is:

1. A flexible earphone cover, comprising:

a flexible main body configured to substantially encase a portion of an earphone, wherein the flexible main body defines:

an internal cavity for receiving the earphone;

a first opening at a side of the cavity for receiving the earphone there-through;

a second opening at a side of the cavity, the second opening being smaller than the first opening;

a third opening at a side of the cavity, the third opening being smaller than the first opening and the second opening; and a fourth opening on the same side of the cavity as the first opening and next to the first opening, the fourth opening being smaller than the third opening; and a flexible ear cone extending from the main body, the flexible ear cone defining a converging passageway from the second opening to an exit configured to direct sound into an ear canal of a user.

2. The flexible earphone cover of claim 1, further comprising: a fifth opening on the same side of the cavity as the third opening and next to the third opening, the fifth opening being smaller than the third opening.

3. The flexible earphone cover of claim 2, wherein at least one opening of the third opening, the fourth opening, and the fifth opening has a dimension larger than a dimension of a hole on the earphone that is being exposed by the corresponding opening.

4. The flexible earphone cover of claim 2, wherein the fourth opening has substantially identical size as the fifth opening.

5. The flexible earphone cover of claim 2, wherein the fourth opening and the fifth opening are in circular shapes.

6. The flexible earphone cover of claim 2, wherein the fourth opening and the fifth opening have shapes that match the shapes of corresponding holes for sensors on the earphone.

7. The flexible earphone cover of claim 2, wherein the fourth opening and the fifth opening are configured to pass signals for corresponding sensors on the earphone to detect a wear status of the earphone.

8. The flexible earphone cover of claim 2, wherein an angle between a longitudinal axis that extends through a center of the ear cone and a longitudinal axis that extends through a center of the first opening is between about 55 degrees and about 80 degrees.

9. The flexible earphone cover of claim 2, wherein the third opening is configured to pass sound from a treble hole in the earphone into the ear of the user.

10. The flexible earphone cover of claim 2, wherein the third opening is configured to pass sound in a treble range of frequencies into the ear of the user.

11. The flexible earphone cover of claim 2, wherein an entire outer surface of the earphone cover is substantially smooth with no sharp edges.

12. The flexible earphone cover of claim 2, wherein the ear cone defines multiple substantially parallel slits at the exit.

13. The flexible earphone cover of claim 12, wherein the ear cone comprises three substantially parallel slits, where the middle slit is substantially longer than the other two slits.

14. The flexible earphone cover of claim 2, wherein the main body is configured not to cover any holes or sensors formed in the earphone.

15. The flexible earphone cover of claim 2, wherein the third opening is formed at an opposite side of the main body to the first opening.

16. The flexible earphone cover of claim 15, wherein the third opening is offset from a longitudinal axis formed through the first opening.

17. The flexible earphone cover of claim 16, wherein the third opening has a stadium shape.

18. The flexible earphone cover of claim 16, wherein the third opening has a shape that matches the shape of a corresponding hole formed in the earphone.

19. The flexible earphone cover of claim 2, wherein the main body and ear cone are integrally formed out of a material having a uniform thickness.

20. The flexible earphone cover of claim 2, wherein the main body and ear cone are integrally formed out of a material having a thickness that is thicker near the first opening than the remainder of the main body and ear cone.

21. The flexible earphone cover of claim 2, wherein the main body and ear cone are integrally formed out of a material having a thickness that is thinner near the first opening than the remainder of the main body and ear cone.

22. The flexible earphone cover of claim 2, wherein the earphone cover is made from an injection molded flexible elastomer.

23. The flexible earphone cover of claim 2, wherein the earphone cover is made from an elastomer that does not substantially lose its grip when wet.

24. The flexible earphone cover of claim 2, wherein the earphone cover is made from an elastomer that is injection molded into an injection gate within the internal cavity.

25. The flexible earphone cover of claim 2, wherein the first opening is an oval or oblong.

26. The flexible earphone cover of claim 2, wherein the main body has a logo integrally formed therein.

27. A method of making a flexible earphone cover comprising:

integrally forming a flexible main body and ear cone by injection molding a flexible elastomer to form:

(i) the flexible main body defining:

an internal cavity for receiving an earphone;

a first opening at a side of the cavity for receiving the earphone there-through;

a second opening at a side of the cavity, the second opening being smaller than the first opening;

a third opening at a side of the cavity, the third opening being smaller than the first opening and the second opening; and a fourth opening next to the first opening and a fifth opening next to the third opening, the fourth opening and the fifth opening being smaller than the third opening; and (ii) the flexible ear cone that extends from the main body and defines a converging passageway from the second opening to an exit.

28. The method of claim 27, wherein the flexible main body is pulled behind a head of the earphone to remove wrinkles or blisters on a surface of the flexible earphone cover.

29. The method of claim 27, wherein the flexible ear cone further defines multiple substantially parallel slits at the exit.

* * * * *